US005930577A

United States Patent [19]

Forsthoefel et al.

[11] Patent Number: 5,930,577

[45] Date of Patent: Jul. 27, 1999

[54] REGISTERING IMAGES ON THE FRONT AND ON THE BACK OF A SUBSTRATE USING HIGH RESOLUTION SHEET MEASUREMENT

[75] Inventors: Bradley J. Forsthoefel, Walworth; Donato D. Evangelista, Webster; Ronald P. Booth, Sr., Pittsford; Gary W. Roscoe, Fairport, all of N.Y.

[73] Assignee: Xerox Corporation, Stamford, Conn.

[21] Appl. No.: 09/128,227

[22] Filed: Aug. 3, 1998

[51] Int. Cl.[6] ..... G03G 15/00

[52] U.S. Cl. ..... 399/401; 271/301

[58] Field of Search ..... 399/364, 396, 399/401, 309, 394; 271/301

[56] References Cited

U.S. PATENT DOCUMENTS

| | | | |
|---|---|---|---|
| 4,416,534 | 11/1983 | Kluger | 399/396 |
| 4,519,700 | 5/1985 | Barker et al. | 399/394 |
| 4,673,279 | 6/1987 | Brown | 399/402 |
| 4,824,090 | 4/1989 | Booth, Sr. et al. | 271/3.03 |
| 4,971,304 | 11/1990 | Lofthus | 217/227 |
| 4,990,965 | 2/1991 | Kiya | 399/364 X |
| 5,078,384 | 1/1992 | Moore | 271/228 |
| 5,094,442 | 3/1992 | Kamprath et al. | 271/227 |
| 5,156,391 | 10/1992 | Roller | 271/227 |
| 5,169,140 | 12/1992 | Wenthe, Jr. | 271/228 |
| 5,172,907 | 12/1992 | Kalisiak | 271/227 |
| 5,278,624 | 1/1994 | Kamprath et al. | 399/395 |
| 5,516,094 | 5/1996 | Sander | 271/259 |
| 5,725,211 | 3/1998 | Blanchard et al. | 271/265.02 |

*Primary Examiner*—S. Lee
*Attorney, Agent, or Firm*—John M. Kelly

[57] ABSTRACT

Registering a first image on a first side of a substrate with a second image on a second side. A motor driven document transport advances a substrate to a transfer station that transfers the first image onto the substrate. The substrate is then inverted and the document transport moves the inverted substrate back to the transfer station to receive a second image. A sensor detects a leading edge and a trailing edge of the substrate, while an encoder operatively connected to the motor produces a predetermined number of pulses per revolution. A counter counts the number of encoder pulses between the leading edge and the trailing edge. The controller then determines the width of the substrate from the number of counted encoder pulses and from the distance the substrate advances per encoder pulse. The controller then controls the document transport to position the substrate at the transfer station such that the second image is registered with the first image.

18 Claims, 3 Drawing Sheets

REGISTERING IMAGES ON THE FRONT AND ON THE BACK OF A SUBSTRATE USING HIGH RESOLUTION SHEET MEASUREMENT

This invention relates to the registering of images on the front and on the back of a substrate when duplex printing.

BACKGROUND OF THE INVENTION

Duplex printing, printing on both sides of a substrate such as a sheet of paper, is usually performed using a multi-pass system. After a substrate has received one image during a first pass through an imaging station, the substrate is inverted and a second image is produced on the other side during a second pass. The 5090 duplicator and the DocuTech® Production Publisher, both of which are products of the Xerox® Corporation, are examples of duplex printing systems.

For various reasons the registration of images on opposites sides of a substrate is not always accurate. The result is image offsets between the images on the front and on the back of a substrate. To reduce these image offsets, active registration systems, systems that sense the substrate position and which correct that position as necessary, have been used. For example, U.S. Pat. No. 4,971,304 to Loftus discloses an apparatus for deskewing and side registering a copy sheet. The apparatus disclosed therein includes copy sheet drivers that are independently controllable to selectively provide differential and non-differential driving of the copy sheet in accordance with the copy sheet position as sensed by at least three sensors. In addition, Loftus discloses the use of a fourth sensor to measure the position of the sheet after deskew and side-registration with respect to the position of a latent image on a photoreceptor and with respect to a transfer station. Similar deskewing and side registration systems have been disclosed in U.S. Pat. Nos. 5,169,140; 5,156,391; 5,094,442; 5,078,384; 5,172,907; and 5,278,624. Other registration systems which are mechanical in nature deskew and side register by urging a copy sheet against a guide or gate. Examples of such mechanical registration systems are disclosed in U.S. Pat. Nos. 4,416,534; and 4,519,700.

While the multipass duplex registration systems used in the 5090 duplicator and the DocuTech® Production Publisher systems are generally successful they are not as precise as some end users might desire. One specific problem with image registration systems relates to registration errors that develop because of substrate dimension tolerances. For example, a given substrate might vary ±1 mm from a nominal dimension. Because most registration systems use the same registration edge regardless of the plex of a sheet (i.e. front or back), dimension variations translate into registration errors when duplex printing. Therefore a multi-pass duplex registration system that corrects for dimensional variations in a substrate's dimensions would be beneficial in improving image registration.

SUMMARY OF THE INVENTION

In accordance with one aspect of the present invention there is provided an apparatus for registering a first image printed on a first side of a substrate with a second image printed on a second side of the substrate. A servo motor driven document transport moves a substrate to a transfer station that transfers a toner image onto the substrate. The substrate is subsequently inverted and the servo motor driven document transport moves the inverted substrate back to the transfer station. During transport a sensor detects a leading edge and a trailing edge of the inverted substrate while an encoder operatively connected to the servo motor produces a predetermined number of pulses per servo motor revolution. A counter counts the number of encoder pulses that occur between the leading edge and the trailing edge of the substrate. A controller then determines the width of the substrate from the total number of encoder pulses and from a predetermined distance that the substrate advances per encoder pulse. The controller then compares the measured width with the expected width and regulates the document transport so as to position the substrate at the transfer station such that the first image and the second image are registered.

BRIEF DESCRIPTION OF THE DRAWINGS

These and other aspects of the invention will become apparent from the following descriptions to illustrate a preferred embodiment of the invention read in conjunction with the accompanying drawings wherein the same reference numerals have been applied to like parts and in which.

DETAILED DESCRIPTION OF AN EMBODIMENT OF THE INVENTION

Figure 1:
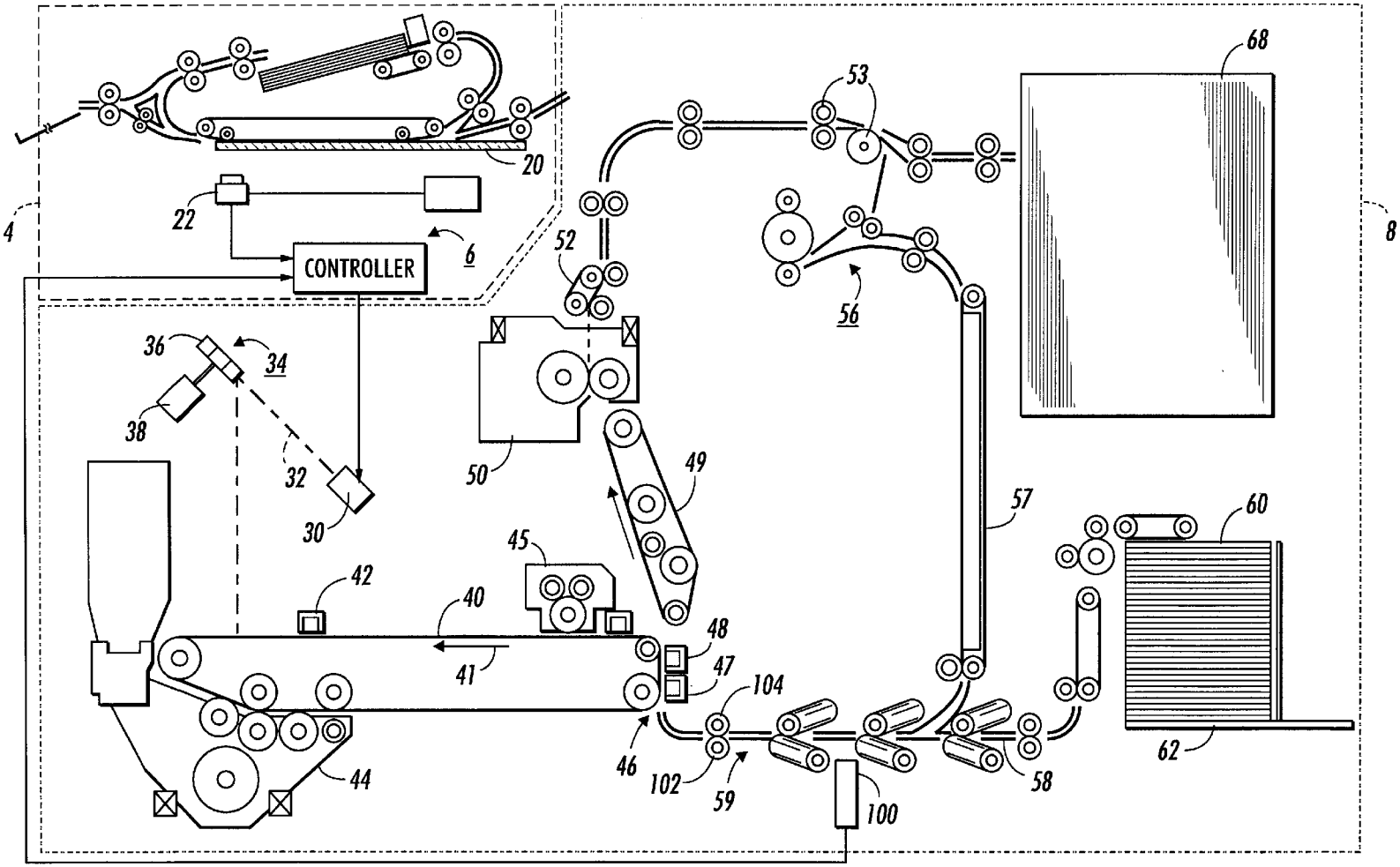
FIG. 1 is a schematic view depicting an electrophotographic printing machine that incorporates the present invention.

FIG. 1 shows an exemplary printing system, a digitial copier, that is suitable for use with the principles of the present invention. Generally, the printing system includes a scanner section 4, a controller section 6, and a printer section 8. The scanner section 4 includes a transparent platen 20 on which a document to be scanned is located. One or more linear arrays 22 are supported for reciprocating scanning movement below the platen 20. An array 22 provides image signals for pixels that are representative of the image being scanned which, after suitable processing, are output to the controller section 6. The image signals from the array 22 are converted to digital image signals that enable the controller section 6 to store and handle image data. The control section 6, commonly called an electronic subsystem (ESS), includes control electronics which prepares and manages the flow of image data between the scanner section 4 and the printer section 8. The control section 6 may include both a user interface suitable for enabling an operator to program a particular print job and a memory for storing image data. The printer section 8 comprises a laser-type printer.

Generally, all machine functions are controlled by the control section 6. Preferably, the control section 6 is microprocessor-based and controls all of the machine steps and functions described herein, and others, including the operation of the document feeders, the operation of the document and copy sheet deflectors or gates, and the operation of the sheet feeder drives and downstream finishing devices. Furthermore, the control section 6 regulates the storage and comparison of the counts of copy sheets, the number of documents in a document set, the desired number of copies, and the user interface. Additionally, conventional document handler sensors or switches that help keep track of the position of moving substrates are input to the control section as required.

After a digital representation of an image of a print job is scanned and stored in the control section 6, a raster output scanner creates an latent electrostatic images on a photoreceptor 40. The raster output scanner includes a laser diode 30 that produces a laser beam 32 that is a modulated in accordance with video data signals from the control section 6. The video data signals encode the laser beam with information suitable to reproduce the digital representation of the image. The laser beam 32 is directed onto a polygon 34 that has a plurality of mirrored facets 36. The polygon is rotated by a polygon motor 38. As the polygon rotates the laser beam 32 is swept across the photoreceptor 40 as the photoreceptor rotates in the direction 41. The sweeping laser beam exposes an output scan line on the photoreceptor 40, thereby creating an output scan line latent electrostatic image of the video data signals from the control section 6. Since the photoreceptor moves in the direction 41, by properly modulating the laser diode 30 subsequent output scan lines produce a desired electronstatic latent image on the photoreceptor.

Before being exposed, the photoreceptor is initially charged by an upstream corotron 42. Subsequent to exposure the latent electrostatic image on the photoreceptor is developed by a developer 44, resulting in a toner image on the photoreceptor 40. The toner image is then transferred at a transfer station 46 onto a substrate from an input tray 60. After transfer, any residual toner particles on the photoreceptor 40 are removed by a cleaning station 45.

During simplex operation (only one side of a substrate is printed) or during the first plex of a duplex operation, a substrate is removed from the input tray 60 by a main paper transport 58 and inserted into a servo motor driven document transport 59. The servo motor driven document transport advances the substrate so that it properly overlays a developed image on the photoreceptor 40 at the transfer station 46. There, a corona generating device 47 charges the substrate to the proper magnitude and polarity. This attracts the toner image from photoreceptor 40 onto the substrate. This is the first toner image. After transfer, a corona generator 48 charges the substrate to the opposite polarity to detack the substrate from the photoreceptor 40. A conveyor 49 then advances the substrate to a fusing station 50. There the first toner image is permanently fused to the substrate. After fusing, the substrate is fed through a decurler 52. The decurler 52 bends the sheet in a first direction to put a known curl in the substrate, and then it bends the substrate in the opposite direction to remove that curl. Forwarding rollers 53 then advance the substrate either to an output tray 68 (if simplex operation, or after fusing of the second image in duplex operation) or to a duplex inverter 56 that inverts the substrate. A substrate inverted by the duplex inverter 56 travels via a vertical transport 57 back into the servo motor driven document transport 59 for registration with a second toner image on the photoreceptor 40. After registration the second toner image is transferred to the substrate at transfer station 46.

The principles of the present invention specifically relate to registering the second toner image with the first toner image despite substrate dimension tolerances. A two step process is employed, first measuring the width of the substrate and then using the measured width to control registration such that the images on both sides of the substrate are registered.

Figure 2:
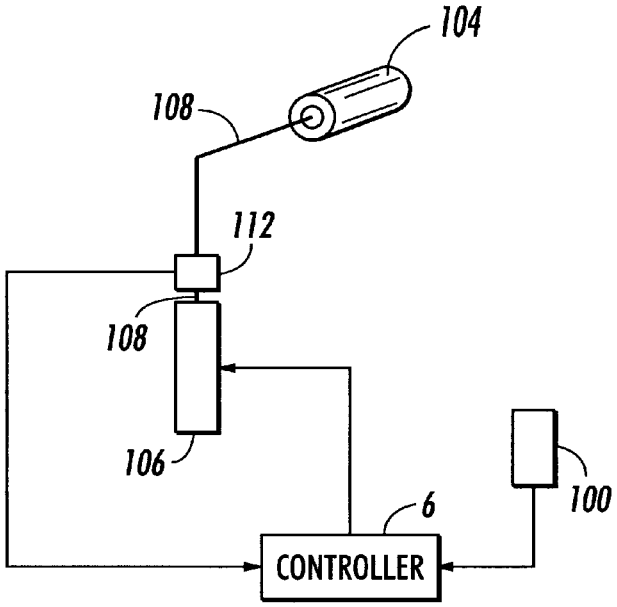
FIG. 2 is a simplified schematic view of selected printing machine elements that are specifically important to the principles of the present invention.

Still referencing FIG. 1, the measurement of the substrate width involves signals from an edge sensor 100. That sensor senses the leading and trailing edges of a substrate as it passes through the servo motor driven document transport 59. The servo motor driven document transport 59 includes an idler roller 102 and a driven roller 104. Turning now to FIG. 2, the driven roller is driven by a servo motor 106 via a linkage 108. The servo motor in turn is powered by electrical energy from the controller system 6. As shown in FIG. 2, the output of the edge sensor 100 is applied to the controller system 6.

Still referencing FIG. 2, a rotary encoder 112 is attached to the linkage 108. That encoder outputs a predetermined number of encoder pulses to the controller system 6 per servo motor revolution. Additionally, the idler roller 102 and the driven roller 104 advance a substrate through the servo motor driven document transport 59 a predetermined distance for every revolution of the servo motor. Thus, each encoder pulse represents a predetermined advancement of the substrate through the servo motor driven document transport 59.

Figure 3:
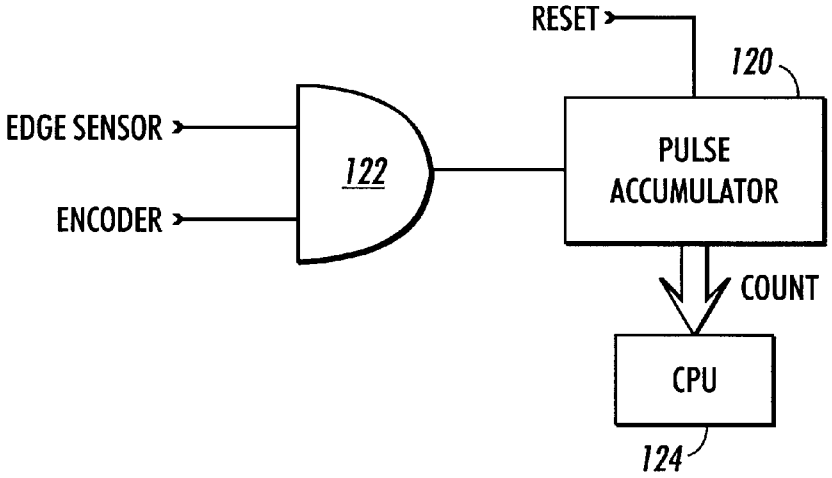
FIG. 3 is a electronic schematic of a pulse accumulator accumulating encoder pulses between the leading edge and the trailing edge of a substrate passing through a servo motor driven document handler.

The controller system 6 uses the time between the leading edge of a substrate and the trailing edge of a substrate to gate encoder pulses into a pulse accumulator. FIG. 3 shows one simplified method of doing this. The input to a pulse accumulator 120 is the output of an AND gate 122. With the edge sensor 100 configured to output a HIGH signal between the leading and trailing edge of a substrate the encoder pulses are input to the pulse accumulator. The pulse accumulator then outputs a count to a CPU 124. Based upon a predetermined substrate advancement through the servo motor driven document transport 59 per edge sensor pulse, the width of the substrate is determined from the count.

Figure 4:
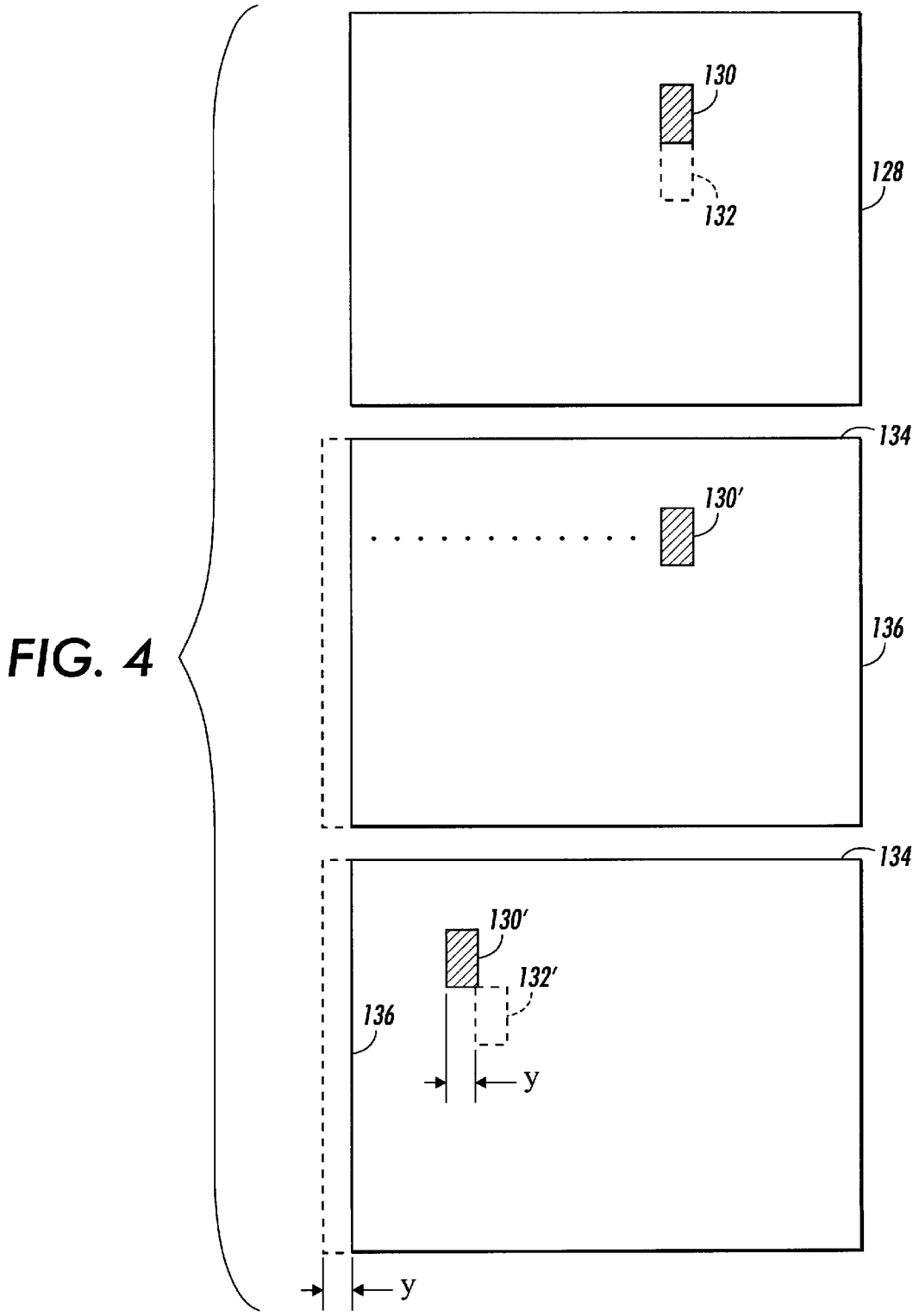
FIG. 4 is an illustrative example of an original document having images on both of its sides and of the results of a prior art scheme when a copy substrate is too short.

With the width of the substrate known it is then possible to accurately register images on separate sides of the substrate. FIG. 4 helps explain how this is accomplished. Consider an original document 128 having an image 130 on a first side and an image 132 on a second side.

Furthermore, assume that the original document is a perfect 8½×11 inches. Now, assume that the first side of the original has been copied on the first side of a copy substrate 134 that is slightly too small (width is less than 11 inches) by a distance Y. The image 130 on the original is copied as an image 130'. After the copy substrate 134 is inverted, what was the leading edge 136 during the first pass through the transfer station is now a trailing edge. Since the copy substrate 134 is too short, without correction the image 132 of the original would be copied as the image 132' on the second side of the copy rate 134. Thus the copied images 130' and 132' would no longer align as they did in the original.

However, since the error in the width of the copy substrate 134 is Y, it is a simple matter for the controller system 6 to control the registration of the inverted copy substrate 134 with the toner image on the photoreceptor such that the image 132' aligns with the image 130' . This can be accomplished by shifting the registration of the second image to the left an amount equal to Y.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

We claim:

1. An apparatus for registering a first image printed on a first side of a substrate with a second image printed on a second side of the substrate, the apparatus comprising:

a photoreceptor having a first toner image and a second toner image;

a transfer station for transferring said first toner image and said second toner image from said photoreceptor onto the substrate;

a document transport having a drive motor controlled by a drive signal, said document transport for advancing the substrate to said transfer station to receive said first toner image;

an inverter for inverting the substrate after the substrate has received said first toner image and for inserting the inverted substrate back into the document transport to receive said second toner image;

an encoder for producing a predetermined number of encoder pulses per revolution of said drive motor;

a sensor for detecting a leading edge and a trailing edge of the substrate as the substrate advance through said document transport; and a controller receiving encoder pulses and receiving leading edge and trailing edge information from said sensor, said controller for determining a width of the substrate from said encoder pulses and from said leading edge and trailing edge information, said controller further for controlling said document transport by applying drive signals such that said second toner image is registered with said first toner image.

2. An apparatus according to claim 1, wherein said document transport further includes a driven roller that is connected to said drive motor by a linkage.

3. An apparatus according to claim 2, wherein said encoder is operatively connected to said linkage.

4. An apparatus according to claim 1, wherein the leading edge of the substrate before receiving the first toner image is the trailing edge of the substrate before receiving the second toner image.

5. An apparatus according to claim 1, further including a fuser for fusing said first toner image onto the substrate before the substrate is inverted by said inverter.

6. An apparatus according to claim 1, wherein said controller includes a logic gate for gating said encoder pulses with said leading edge and trailing edge information.

7. An apparatus according to claim 6, wherein said controller further includes a pulse accumulator for accumulating said gated encoder pulses.

8. A marking machine, comprising:

a moving photoreceptor;

a charging station for substantially uniformly charging said photoreceptor;

an exposure station for exposing said uniformly charged photoreceptor to produce a first latent image and a second latent image;

a developer station for developing toner onto said first latent image and onto said second latent image so as to produce a first toner image and a second toner image;

a transfer station for transferring said first toner image and said second toner image onto a substrate;

a document transport having a drive motor controlled by a drive signal said document transport for advancing a toner receiving substrate from a substrate holder to said transfer station;

an inverter for inverting the toner receiving substrate after that substrate has received said first toner image and for inserting the inverted toner receiving substrate back into the document transport to receive said second toner image;

an encoder for producing a predetermined number of encoder pulses per revolution of said drive motor;

a sensor for detecting a leading edge and a trailing edge of the substrate as the substrate advance through said document transport; and a controller receiving encoder pulses and receiving leading edge and trailing edge information from said sensor, said controller for determining a width of the substrate from said encoder pulses and from said leading edge and trailing edge information, said controller further for controlling said document transport by applying drive signals such that said second toner image is registered with said first toner image.

9. A marking machine according to claim 8, wherein said document transport further includes a driven roller that is connected to said drive motor by a linkage.

10. A marking machine according to claim 9, wherein said encoder is operatively connected to said linkage.

11. A marking machine according to claim 8, wherein the leading edge of the substrate before receiving the first toner image is the trailing edge of the substrate before receiving the second toner image.

12. A marking machine according to claim 8, further including a fuser for fusing said first toner image onto the substrate before the substrate is inverted by said inverter.

13. A marking machine according to claim 8, wherein said controller includes a logic gate for gating said encoder pulses with said leading edge and trailing edge information.

14. A marking machine according to claim 13, wherein said controller further includes a pulse accumulator for accumulating said gated encoder pulses.

15. A method for registering a first image on a first side of a substrate and a second image printed on a second side of the substrate, comprising the steps of:

producing a first toner image and a second toner image on a photoreceptor;

moving a substrate from a substrate holder to a transfer station using a motor that is operatively connected to a pulse encoder;

transferring said first toner image onto said substrate;

inverting said substrate;

moving said inverted substrate back to said transfer station;

determining a width of said substrate by sensing a leading edge and a trailing edge of said substrate as said substrate is moved to said transfer station and by knowing how many encoder pulses are output per revolution of said motor; and transferring said second toner image onto said inverted substrate;

wherein said moving of said inverted substrate back to said transfer station is performed using the determined width of said substrate such that said second toner image is aligned with said first toner image.

16. The method according to claim 15, further including a step of fusing said first toner image onto the substrate before the inverting said substrate.

17. The method according to claim 16, wherein the step of determining the width of said substrate is performed after fusing.

18. The method according to claim 15, wherein the step of producing a first toner image and a second toner image on a photoreceptor includes the step of scanning a first image and a second image.

* * * * *